US006431472B1

(12) United States Patent
Tian et al.

(10) Patent No.: US 6,431,472 B1
(45) Date of Patent: Aug. 13, 2002

(54) FUEL INJECTOR NOZZLE WITH OUTWARDLY OPENING CHECK VALVE

(75) Inventors: Ye Tian, Bloomington; Norval J. Wiemken, Dwight, both of IL (US)

(73) Assignee: Caterpillar Inc., Peoria, IL (US)

( * ) Notice: Subject to any disclaimer, the term of this patent is extended or adjusted under 35 U.S.C. 154(b) by 31 days.

(21) Appl. No.: 09/742,636

(22) Filed: Dec. 21, 2000

(51) Int. Cl.[7] ..... F02M 51/00
(52) U.S. Cl. ..... 239/585.1; 239/533.7
(58) Field of Search ..... 239/533.7, 533.9, 239/533.12, 533.15, 533.3, 585.1, 585.4, 585.5

(56) References Cited

U.S. PATENT DOCUMENTS

| | | | | |
|---|---|---|---|---|
| 1,271,670 A | | 7/1918 | Conrad | |
| 3,481,542 A | | 12/1969 | Huber | |
| 3,610,529 A | | 10/1971 | Huber et al. | |
| 3,942,485 A | | 3/1976 | Suda et al. | |
| 3,967,597 A | | 7/1976 | Schlagmuller et al. | |
| 4,164,326 A | | 8/1979 | Deckard | |
| 4,187,987 A | | 2/1980 | Raue | |
| 4,206,635 A | | 6/1980 | Teerman | |
| 4,342,443 A | | 8/1982 | Wakeman | |
| 4,482,094 A | | 11/1984 | Knape | |
| 4,606,322 A | | 8/1986 | Reid et al. | |
| 4,717,079 A | | 1/1988 | de Concini | |
| 4,836,453 A | | 6/1989 | Poehlman | |
| 5,035,360 A | | 7/1991 | Green et al. | |
| 5,183,209 A | | 2/1993 | Ricco et al. | |
| 5,189,782 A | | 3/1993 | Hickey | |
| 5,235,954 A | | 8/1993 | Sverdlin | |
| 5,263,647 A | | 11/1993 | Cerny et al. | |
| 5,301,875 A | | 4/1994 | Gant et al. | |
| 5,392,994 A | * | 2/1995 | Zizelman et al. | 239/101 |
| 5,419,492 A | | 5/1995 | Gant et al. | |
| 5,482,213 A | | 1/1996 | Matsusaka et al. | |
| 5,535,723 A | | 7/1996 | Gibson et al. | |
| 5,556,031 A | | 9/1996 | Cooke et al. | |
| 5,673,853 A | | 10/1997 | Crofts et al. | |
| 5,715,996 A | * | 2/1998 | Cooper et al. | 137/537 |
| 5,775,301 A | | 7/1998 | Ganser | |
| 5,884,850 A | | 3/1999 | Norgauer | |
| 5,979,789 A | | 11/1999 | Sullivan et al. | |
| 6,000,628 A | | 12/1999 | Lorraine | |
| 6,000,638 A | | 12/1999 | Martin | |
| 6,024,302 A | | 2/2000 | Sumida et al. | |
| 6,042,028 A | | 3/2000 | Xu | |
| 6,056,264 A | | 5/2000 | Benson et al. | |
| 6,109,540 A | | 8/2000 | Coldren et al. | |

FOREIGN PATENT DOCUMENTS

EP 0 967 386 A2 12/1999

OTHER PUBLICATIONS

Ser. No. 09/611,578, filed Jul. 25, 2000—"Reverse Acting Nozzle Valve And Fuel Injector Using Sam".

* cited by examiner

*Primary Examiner*—Lesley D. Morris
(74) *Attorney, Agent, or Firm*—Mike R. Huber

(57) ABSTRACT

A nozzle assembly for fuel injection in an internal combustion engine comprising a nozzle tip with a hollow interior defining a fuel chamber. The nozzle tip has at least one spray orifice opening to an outer surface on the nozzle tip, and a valve member at least partially disposed within the nozzle tip. The valve member is moveable between a first position in which the valve member contacts an upper valve seat to prevent fluid communication of fuel from the fuel chamber to the at least one spray orifice, and a second outward position in which the valve member contacts a lower valve seat to allow fluid communication of fuel from the fuel chamber to the at least one spray orifice. The valve member is directly electrically actuated, preferably by a solenoid. Further, the valve member is biased in the closed position and the valve member is pressure balanced when high pressure fuel in present in the fuel chamber.

13 Claims, 3 Drawing Sheets

FUEL INJECTOR NOZZLE WITH OUTWARDLY OPENING CHECK VALVE

TECHNICAL FIELD

The present invention relates generally to fuel injector nozzles and specifically to a fuel injector nozzle with an outward opening check valve member.

BACKGROUND ART

Fuel injection is a vital aspect of engine operation, having a significant impact on emissions and performance. Consequently, it is vital to control fuel injection timing and injection quanity.

Many different types of injectors have been developed to control injection, such as mechanical unit injectors, electronic unit injectors and hydraulically actuated, electronically controlled unit injectors. A check valve member, located in the nozzle assembly of the injector, controls the actual injection of fuel from a fuel chamber in the nozzle assembly to the engine cylinder. Optimal check performance can improve injector timing, engine performance, and emissions.

Many different check valve designs exist. Most conventional check valve designs open inwardly. In an inwardly opening design, the check valve must have an adequate biasing force to remain closed when combustion gases push against the check valve, possibly pushing the check valve off of it's seat allowing combustion gases to undesirably enter the injector. Some check valve designs avoid this problem by employing an outwardly opening check. This is beneficial because combustion gas pushes against the check and actually insure a better seal. However, manufacturing outward opening checks can be more complex because a check stop must be incorporated somewhere within the injector to prevent check overtravel.

Generally, the check valve in conventional injectors is biased in the closed position by a spring or some other biasing force and only opens when fuel pressure exceeds the spring's force (This pressure is referred to as the valve opening pressure—VOP). Unfortunately, this type of design does not provide the exacting control over fuel injection that is desirable as engine emissions requirements become more stringent. One alternative check control design incorporates direct electrical actuation of the check valve wherein a solenoid, opposed to fuel pressure, is used to move the check valve to an open position. However, in most direct electrically actuated check valves, the electrical force needed to move the check valve must be sufficient to overcome the fluid forces exerted on the check valve by the high pressure fuel. This requires the electrical actuators to be larger and slower than optimal.

This invention is directed toward overcoming one or more of the problems identified above.

DISCLOSURE OF THE INVENTION

A nozzle assembly for fuel injection in an internal combustion engine comprising a nozzle tip with a hollow interior defining a fuel chamber; the nozzle tip having at least one spray orifice opening to an outer surface on the nozzle tip; and a valve member at least partially disposed within the nozzle tip. The valve member is moveable between a first position in which the valve member contacts an upper valve seat to prevent fluid communication of fuel from the fuel chamber to the at least one spray orifice, and a second outward position in which the valve member contacts a lower valve seat to allow fluid communication of fuel from the fuel chamber to the at least one spray orifice.

The valve member is directly electrically actuated, specifically by solenoid and armature. Further, the valve member is biased in the closed position and the valve member is pressure balanced when high pressure fuel in present in the fuel chamber.

The nozzle tip comprises an upper body portion which the fuel chamber and the upper valve seat; and a lower body portion, press fit onto the upper body portion, that includes the at least one spray orifice and the lower seat.

In an alternative embodiment, a valve member for use in a nozzle assembly for fuel injection in an internal combustion engine comprises an upper guide portion, a lower guide portion and an enlarged portion. The enlarged portion includes an upper contact surface for contact with an upper valve seat to prevent fluid communication between a fuel chamber defined by the nozzle tip and at least one spray orifice opening to an outer surface on the nozzle tip, and a lower contact surface for contact with a lower valve seat to allow fluid communication between said fuel chamber and the at least one spray orifice.

A method of injecting fuel comprises providing fuel to a fuel chamber defined by a hollow interior in a nozzle tip of a fuel injector; actuating a valve member that is at least partially disposed in the nozzle tip from a first position in which the valve member is in contact with an upper valve seat to prevent fluid communication of fuel from the fuel chamber to at least one spray orifice opening to an outer surface on the nozzle tip, and a second outward position in which the valve member contacts a lower valve seat to allow fluid communication of fuel from said fuel chamber to said at least one spray orifice.

In the preferred embodiment, the step of actuating the valve member is done directly by an electrical actuator. The method further comprises the step of pressure balancing said valve member such that the solenoid only needs to overcome a biasing force that places the valve member in a preferred position.

Finally, a nozzle tip for fuel injection is disclosed comprising an upper body portion with a hollow bore to define a fuel chamber and receive a check valve member and a lower body portion with at least one spray orifice opening to an outer surface on the lower body and a bore to receive a lower guide portion of the valve member. An upper seat is located on the upper body portion to contact an upper contact surface of the valve member and prevent fluid communication of fuel from the fuel chamber to the at least one spray orifice and a lower seat is located on the lower body portion to contact a lower contact surface of the valve member to allow fluid communication of fuel from the fuel chamber to the at least one spray orifice.

BEST MODE FOR CARRYING OUT THE INVENTION

Figure 1:
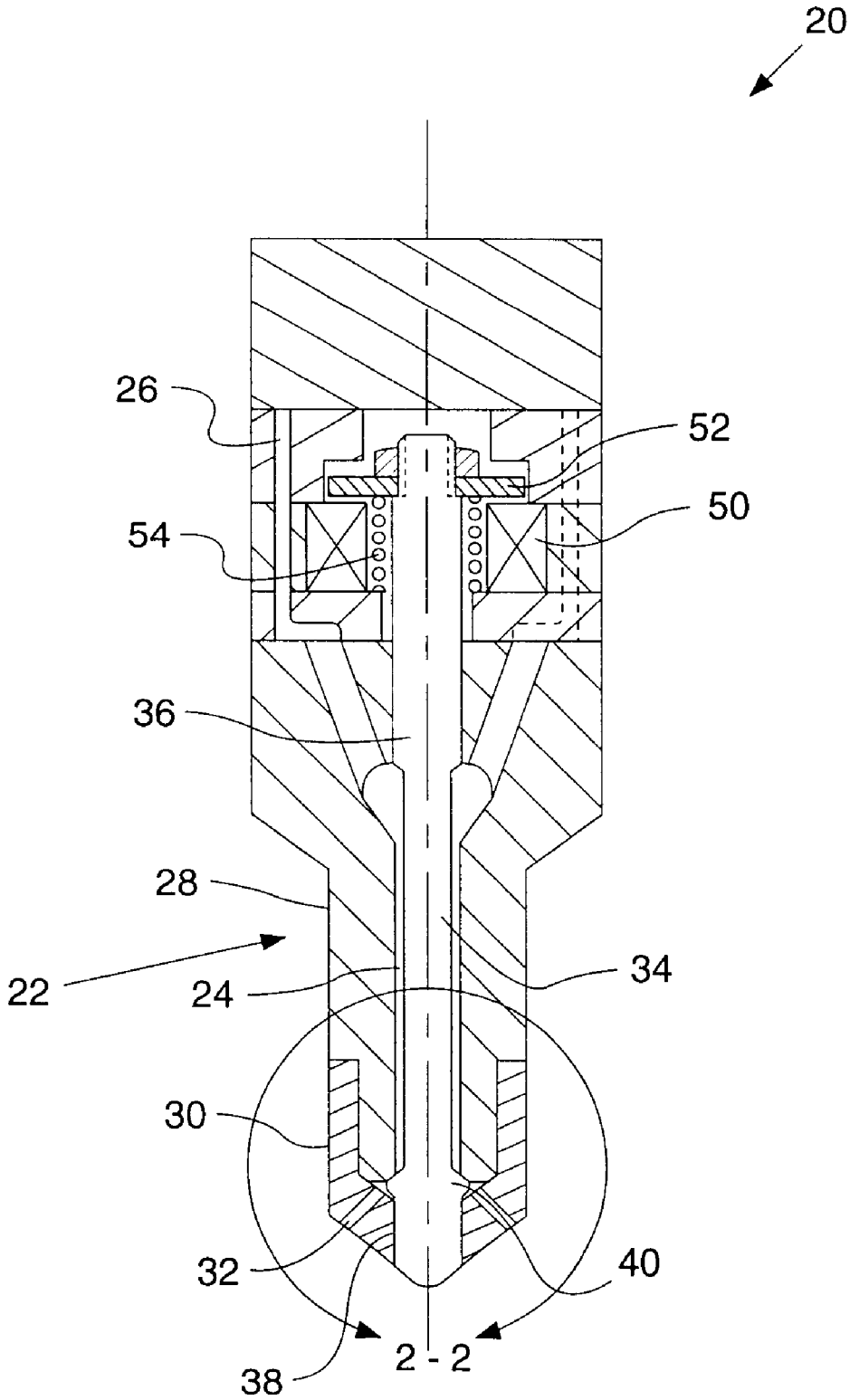
FIG. 1 illustrates a cross sectional view of a nozzle assembly in accordance with the present invention.

FIG. 1 illustrates a nozzle assembly 20. which may be incorporated into a variety of fuel injection systems, including electronic unit injectors (hydraulic or mechanical), common rail systems, gasoline direct injection systems, unit pump systems, and pump/line/nozzle systems. The nozzle assembly 20 includes a nozzle tip 22 which defines a fuel chamber 24. The fuel chamber 24 is connected to a high pressure fuel line 26 which receives fuel from a source of high pressure fuel (not shown). The nozzle tip 22 comprises of an upper body portion 28 and a lower body portion 30 that is press fit onto the upper body portion 28. The lower body portion 30 of the nozzle tip 22 has at least one spray orifice 32 (enlarged on FIGS. 1–3 for demonstration purposes) (preferably multiple orifices) allowing fuel injection from the fuel chamber 24 to the combustion chamber (not shown).

A check valve 34 is at least partially disposed within the nozzle tip 22. The check valve 34 includes an upper guide portion 36, which is disposed within the upper body portion 28, and a lower guide portion 38, which is received in a bore in the lower body portion 30. The check valve 34 also includes an enlarged portion 40 that fits between the upper body portion 28 and the lower body portion 30. (Note that it is not necessary for the lower guide portion 38 to be disposed all the way through lower body portion 30.)

Figure 2:
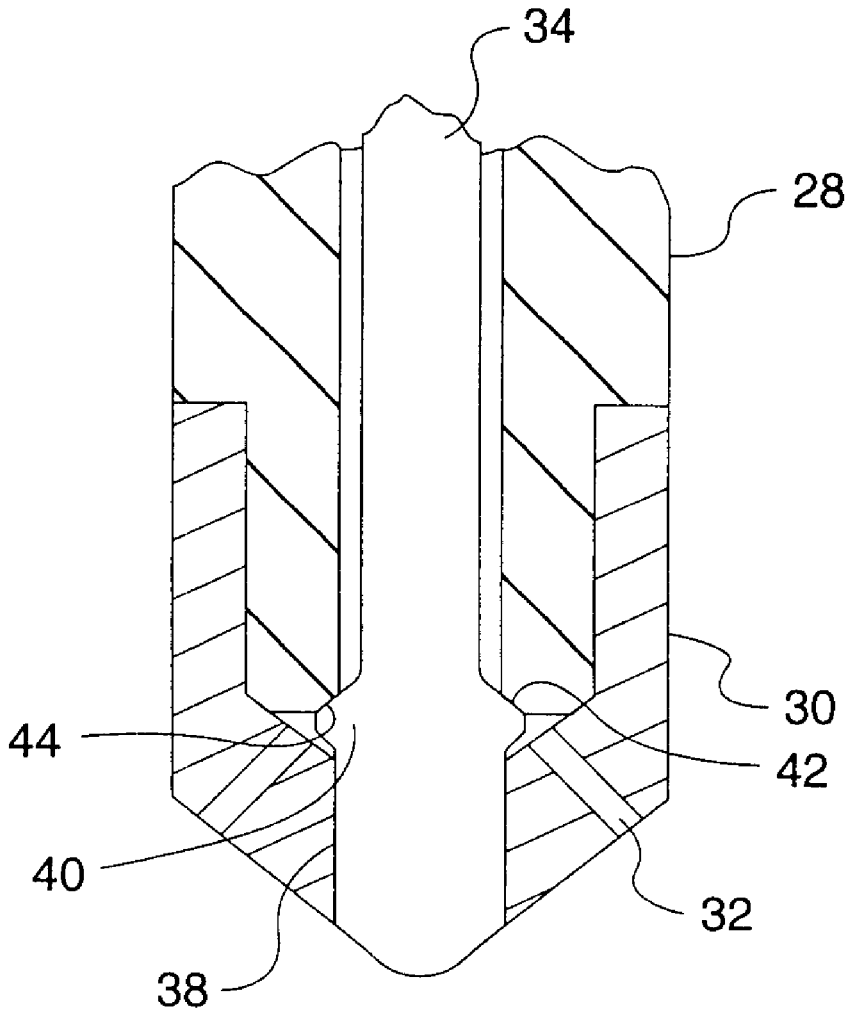
FIG. 2 illustrates an enlarged cross sectional view of the nozzle tip in accordance with the present invention with the check valve member in the closed position.
Figure 3:
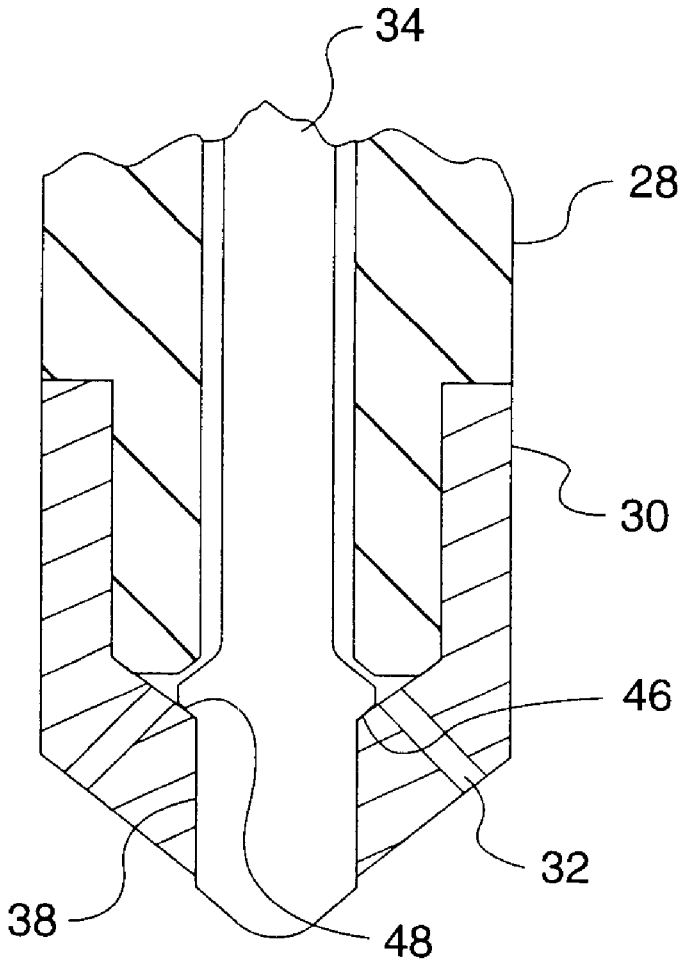
FIG. 3 illustrates an enlarged cross sectional view of the nozzle tip in accordance with the present invention with the check valve member in the open position.

The check valve is moveable between a first position in which an upper contact surface 42 of the enlarged portion 40 contacts an upper seat 44, which is located on the upper body portion 28 of the tip 22, to thereby prevent fluid communication between the fuel chamber 24 and the spray orifices 32, see FIG. 2, and a second position in which a lower contact surface 46 of the enlarged portion 40 contacts a lower seat 48, which is located on the lower body portion 30 of the tip 22, allowing fluid communication between the fuel chamber 24 and the spray orifices 32, see FIG. 3. The lower seat 48 also acts as a check valve stop to prevent over-travel of the check valve 34.

The check valve 34 is directly electrically actuated by a solenoid 50. Specifically, an armature 52 is attached to the check valve 34 and moves the check valve to the second, open position when the solenoid 50 is activated. Although a solenoid and armature are used, a variety of alternatives could be implemented. For example, the check valve 34 could also act as the armature, thereby reducing parts. Further different electric methods could be employed, such as a piezzo stack. In order to actuate the check valve 34 as efficiently and effectively as possible, the check valve 34 is pressure balanced. This means that when high pressure fuel enters the fuel chamber 24, the net fuel forces acting on the check valve 34 as a result of the fuel are balanced and do not bias the check valve 34 in any direction. The check valve 34 is biased in the closed position by an armature spring 54 but other bias or holding mechanisms could be used such as a second coil/electromagnet, or a piezo stack.

It should be noted that the present invention is also useful in conventional check valve member designs. Thus, it is not necessary to operate the present invention with a solenoid, piezo or other type of actuators. It is possible to actuate (or open the valve) using conventional indirect methods (such as using fuel pressure to overcome the valve opening pressure).

INDUSTRIAL APPLICABILITY

Combustion gases are often a concern in the operation of a fuel injector. Specifically, combustion gases can enter an injector's nozzle assembly 20 through the spray orifices 32 and adversely effect injector performance. This is especially a concern when the check valve 34 opens inwardly because the check valve 34 is capable of being pushed inwardly by the combustion gas. However, with an outward moving check valve design, as disclosed herein, the check valve 34 is seated in the upward position; therefore when combustion gases push on the check valve 34, a better seal between the check valve 34 and the upper seat 44 is actually created.

Typically, when an outward moving check design is employed, a check valve stop must be employed to prevent the check valve 34 from moving to far in to the cylinder (not shown). This is often accomplished by incorporating a stop near the biasing mechanism. However, this configuration can be complex to manufacture. By employing a lower seat 48 simply through a press fit lower body portion 30, a check stop is easily incorporated into the nozzle assembly 20 with out significant manufacturing expense or difficulty.

Check valve 34 control is preferably performed by directly electrically actuating the check valve 34. The armature spring 54 biases the check valve 34 in the closed position, against the upper seat 48. The solenoid 50, when activated, pulls the armature 52 down, which is attached to the check valve 34. This results in the check valve 34 moving outwardly to the open position, allowing fluid communication of the high pressure fuel from the fuel chamber 24 to the spray orifices 32. When moved to the open position, the check valve 34 contacts the lower seat 48 which prevents over-travel of the check valve 34 and prevents the armature spring 54 from going solid.

Actuation performance can be enhanced by pressure balancing the check valve 34 when high pressure fuel is present in the fuel chamber 24. High pressure fuel applies significant forces on the check valve 34 which requires the solenoid to be strong enough to not only overcome the biasing force of the armature spring 54 but also the forces imparted by the high pressure fuel. However, by designing the check valve such that when high pressure fuel is present in the fuel chamber, it acts equally on the check in both axial directions, the solenoid then only needs to overcome the biasing force of the armature spring 54 which allows for a smaller solenoid and faster response times.

The above description is intended for illustrative purposes only, and is not intended to limit the scope of the present invention in any way. Thus, those skilled in the art will appreciate that various modifications can be made to the illustrated embodiment without departing from the spirit and scope of the present invention, which is defined in terms of the claims set forth below.

What is claimed is:

1. A nozzle assembly for fuel injection in an internal combustion engine comprising:

a nozzle tip with a hollow interior defining a fuel chamber, said nozzle tip having at least one spray orifice opening to an outer surface on said nozzle tip; and a valve member having a lower guide portion at least partially disposed within said nozzle tip, said valve member moveable between a first position in which said valve member contacts an upper valve seat to prevent fluid communication of fuel from said fuel chamber to said at least one spray orifice, and a second outward position in which said valve member contacts a lower valve seat to allow fluid communication of fuel from said fuel chamber to said at least one spray orifice.

2. The nozzle assembly of claim 1 further comprising an electrical actuator directly acting on said valve member.

3. The nozzle assembly of claim 2 wherein said electrical actuator comprises a solenoid.

4. The nozzle assembly of claim 2 wherein said solenoid comprises an armature attached to said valve member.

5. The nozzle assembly of claim 1 further comprising means to bias said valve member in a desired position.

6. The nozzle assembly of claim 5 wherein said biasing means comprises a spring.

7. The nozzle assembly of claim 1 wherein said valve member is pressure balanced when high pressure fuel is present in said fuel chamber.

8. The nozzle assembly of claim 1 wherein said valve member includes a lower guide that protrudes at least partially into said nozzle tip.

9. The nozzle assembly of claim 1 wherein said nozzle tip comprises:

an upper body portion, wherein said upper body portion includes said fuel chamber and said upper valve seat; and a lower body portion, press fit onto said upper body portion, that includes said at least one spray orifice and said lower seat.

10. The nozzle assembly of claim 9 wherein said lower body portion further comprises a bore which receives a lower guide portion of said valve member.

11. A valve member for use in a nozzle assembly for fuel injection in an internal combustion engine comprising an upper guide portion, an enlarged portion such that said enlarged portion includes an upper contact surface for contact with an upper valve seat to prevent fluid communication between a fuel chamber defined by said nozzle tip and at least one spray orifice opening to an outer surface on said nozzle tip, and a lower contact surface for contact with a lower valve seat to allow fluid communication between said fuel chamber and said at least one spray orifice, and a lower guide portion.

12. The valve member of claim 11 wherein said upper guide portion and said lower guide portion have substantially the same diameter.

13. A nozzle tip for fuel injection comprising:

an upper body portion, said upper body portion comprising a hollow bore to define a fuel chamber and receive a check valve member;

a lower body portion, said lower body portion comprising at least one spray orifice opening to an outer surface on said lower body portion and a bore to receive a lower guide portion of said valve member;

an upper seat located on said upper body portion to contact an upper contact surface of said valve member and prevent fluid communication of fuel from said fuel chamber to said at least one spray orifice;

a lower seat located on said lower body portion to contact a lower contact surface of said valve member to allow fluid communication of fuel from said fuel chamber to said at least one spray orifice.

* * * * *